United States Patent [19]

Delamare

[11] Patent Number: 4,976,074

[45] Date of Patent: Dec. 11, 1990

[54] INFLATABLE VAULT HAVING A MULTILOBED DOUBLE WALL

[75] Inventor: Guy R. Delamare, Le Pecq, France

[73] Assignee: Technip Geoproduction, Paris La Defense, France

[21] Appl. No.: 251,088

[22] Filed: Sep. 29, 1988

[30] Foreign Application Priority Data

Oct. 15, 1987 [FR] France ..... 87 14259

[51] Int. Cl.[5] ..... E04B 1/34

[52] U.S. Cl. ..... 52/2 J

[58] Field of Search ..... 52/2 J, 2 M, 2 N, 222, 52/2 H

[56] References Cited

U.S. PATENT DOCUMENTS

| | | | |
|---|---|---|---|
| 2,782,794 | 2/1957 | White | 52/2 J |
| 2,850,026 | 9/1958 | Leatherman | 52/2 J |
| 3,332,176 | 7/1967 | Knetzer | 52/2 J |
| 3,332,177 | 7/1967 | Sepp | 52/2 J |
| 3,432,609 | 3/1969 | Duvall et al. | 52/2 H |
| 3,751,862 | 8/1973 | Linecker | 52/2 H |
| 4,631,873 | 12/1986 | Parish | 52/2 J |

FOREIGN PATENT DOCUMENTS

| | | |
|---|---|---|
| 539480 | 6/1955 | Belgium . |
| 2225784 | 12/1972 | Fed. Rep. of Germany . |
| 8619380 | 2/1987 | Fed. Rep. of Germany . |
| 2166397 | 8/1973 | France . |
| 2194860 | 3/1974 | France . |
| 2326544 | 4/1977 | France . |

*Primary Examiner*—John E. Murtagh
*Assistant Examiner*—Michele A. Van Patten
*Attorney, Agent, or Firm*—Wenderoth, Lind & Ponack

[57] ABSTRACT

Disclosed is an inflatable value having a multilobed double wall, adapted to be opened out and retracted, and confining a layer of intermural air under pressure. The vault is constructed by assembling side by side a plurality of separate inflatable hollow beams, each of which includes at least two longitudinal panels which are sequentially connected together along at least two longitudinal edges. The panels of each beam are connected together and to panels of adjoining beams by a plurality of short quick-connect type female connectors. The joints between panels of each respective beam are made leaktight by including flexible membranes which span the respective joints. The inflatable vault according to the invention is particularly applicable to the covering of stadiums, swimming pools, tennis courts, restaurants, auditoriums, storage hangers and other large installations.

30 Claims, 19 Drawing Sheets

INFLATABLE VAULT HAVING A MULTILOBED DOUBLE WALL

BACKGROUND OF THE INVENTION

The present invention relates to an inflatable vault having a flexible multilobed double wall, in which only the air space situated between the two walls is pressurized, the area covered by it remaining at ambient pressure. Amongst other aims, this vault is designed to be opened out by simple inflation, and also to be collapsed by deflation, thus making it possible to alternatively cover an area during bad weather and uncover it during good weather.

A vault of this kind can be used for the temporary covering of large installations, such as stadiums having stands intended for spectators. In this case, the vault constitutes an enormous amount of fabric, weighing from fifty to one hundred tons, which is impossible to assemble in the factory, transport and install as a single completely finished unit. Alternatively, if the vault is composed of a plurality of elements, it is advisable that these elements be completely finished and tested at the factory, particularly for the purpose of checking their airtightness. However, it is also desirable that these elements be easily and quickly assembled together, without requiring expensive equipment at the site.

Vaults of this type, which can be opened out and collapsed by simple inflation and deflation and in which only the space between the two walls is pressurized, are already known. Examples of such vaults are in French Pat. Nos. 2,166,397 and 2,326,544.

French Pat. No. 2,166,397 relates to an inflatable structure comprising a series of inflatable boxes which bear against one another when they are inflated, and which are placed between two sheets, to which they are fixed and which are tensioned by the boxes when the structure is inflated. Because of the design of this structure, it cannot be used for constructions of large dimensions. Such use is one of the objects of the present invention.

French Pat. No. 2,326,544 relates to a flexible inflatable structure consisting of a bay which has at least two walls, is adapted to be opened out and folded up or collapsed, and is composed of a succession of contiguous, flattenable, pressurizable chambers whose dividing walls brace the outer, inner and sometimes middle wall of the bay. The numerous elements of which the vault is composed are simple elementary panels of leaktight fabric, which have to be joined on the site to make continuous joints which are both resistant and leaktight over great lengths. The assembly of these panels requires very accurate manufacturing tolerances and also considerable, delicate assembly work on the site. Thus, there is no assurance that the resulting product will be completely reliable.

Moreover, these two documents do not describe an inflation means for enabling an enormous amount of air to be blown in under light pressure between the two walls. Such inflation means is necessary in order to open out a vault of large dimensions within a period of time sufficiently short to be of practical interest.

SUMMARY OF THE INVENTION

The present invention, therefore, seeks to provide a vault produced by the assembly of a plurality of entirely prefabricated inflatable beams, which have been tested at the factory and are of slight mass, easily foldable into packages transportable by truck, and assembleable on the site in the deflated state on the ground. It is also an object that the beams be assembleable with primitive but reliable means which can be used quickly, even by only slightly skilled labor, and without using either lifting means or scaffolding.

The present invention also seeks to provide a vault which, although subdivided into numerous elements, incorporates pressurizable means which has a variable geometry and a large section, thus permitting rapid inflation and expansion.

The present invention, therefore, has as its object the provision of an inflatable vault which has a multilobed double wall, is adapted to be opened out and collapsed, and confines a layer of intermural air under pressure, characterized in that it is obtained by assembling side by side a plurality of separate inflatable hollow beams, each of which is composed of a flexible envelope. Each of the flexible envelopes ensures the continuity of the leaktightness of the space confined thereby and comprises principally at least two longitudinal panels, whose surfaces are sequent along at least two longitudinal edges at which said panels are not only joined to one another but also joined to the panels of the adjacent beams, with the aid of a plurality of quick-connect type elongated female connectors which, along with male connectors along the at least two longitudinal edges, form quick connect means. Each of the quick-connect means which connect the inflatable beams to one another comprises a first portion including a series of flaps extending from said panels along at least one of their longitudinal edges, each flap being equipped with a bead (i.e., male connector) bordering its free end, and a second portion including a plurality of sectional female connectors provided with at most as many longitudinal slots as there are panels to be joined, said sectional members being inserted one behind the other, simultaneouslY from one end to the other of each of said flaps which are to be joined together.

According to yet another characteristic of the invention, the means ensuring the continuity of the leak-tightness of the spaces confined by the flexible envelopes of the beams comprises leaktight membranes longitudinally connecting together the inner faces of the two adjacent panels of each beam.

Another object of the invention is to provide a method of utilizing the inflatable vault, characterized in that the vault is constructed by a first operation which includes assembling together, with the aid of the quick-connect means, the panels of the plurality of deflated beams, laid flat one over the other, and by a second operation comprising opening out, inflating and rigidifying each beam by separately pressurizing each beam one after another by deflating a leaktight temporary closure means so as to open the confined internal space to the pressurized fluid supply duct. The opening out of the vault is maintained by inflation of the leaktight means for closing the confined internal space.

BRIEF DESCRIPTION OF THE DRAWING FIGURES

The characteristics and advantages of the invention will be better understood on perusal of the following description of various embodiments of the invention and with reference to the accompanying drawings, in which.

DETAILED DESCRIPTION OF THE INVENTION

Figure 1:
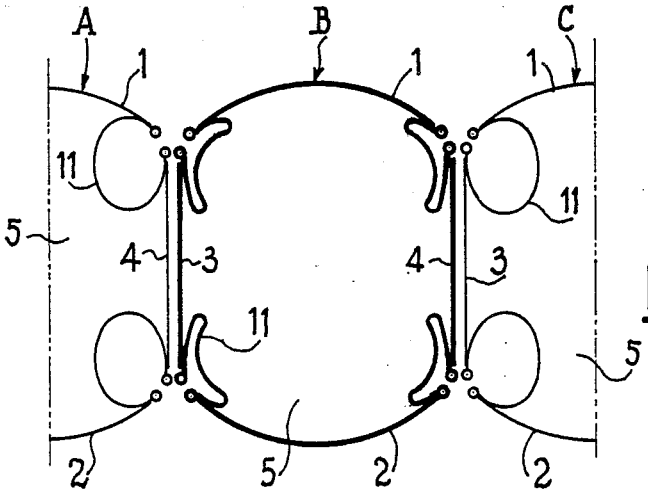
FIG. 1 is a schematic view in section of a portion of a vault according to the invention, composed of beams comprising four connected panels.

FIG. 1 shows a plurality of inflatable beams A, B, C . . . , which are joined together side by side to form the vault according to the invention.

In this embodiment, each beam A, B, C . . . , is composed of four longitudinal panels joined at the corners to form a box girder, of which two opposite panels 1 and 2 define outer and inner panels and respectively constitute one of the lobes of the inner wall and one of the lobes of the multilobed outer wall of the vault. The other two panels 3 and 4 connected between the panels 1 and 2 form web panels of the box girder and constitute bracing ribs which transmit and balance the lobing tensions of the outer and inner panels resulting from internal pressure of the confined space 5. These web panels 3 and 4 serve another fundamental role in this beam assembly; they ensure the leaktightness of the vault between consecutive beams. The internal pressure of the confined space 5 in each of the beams will force adjacent web panels 3, 4 of adjacent beams against each other, over their entire surface.

Each beam A, B, C . . . may alternatively be composed of two longitudinal panels whose surfaces are sequent and connect along two longitudinal edges, or of three longitudinal panels whose surfaces are sequent and connect along three longitudinal edges.

Figure 2:
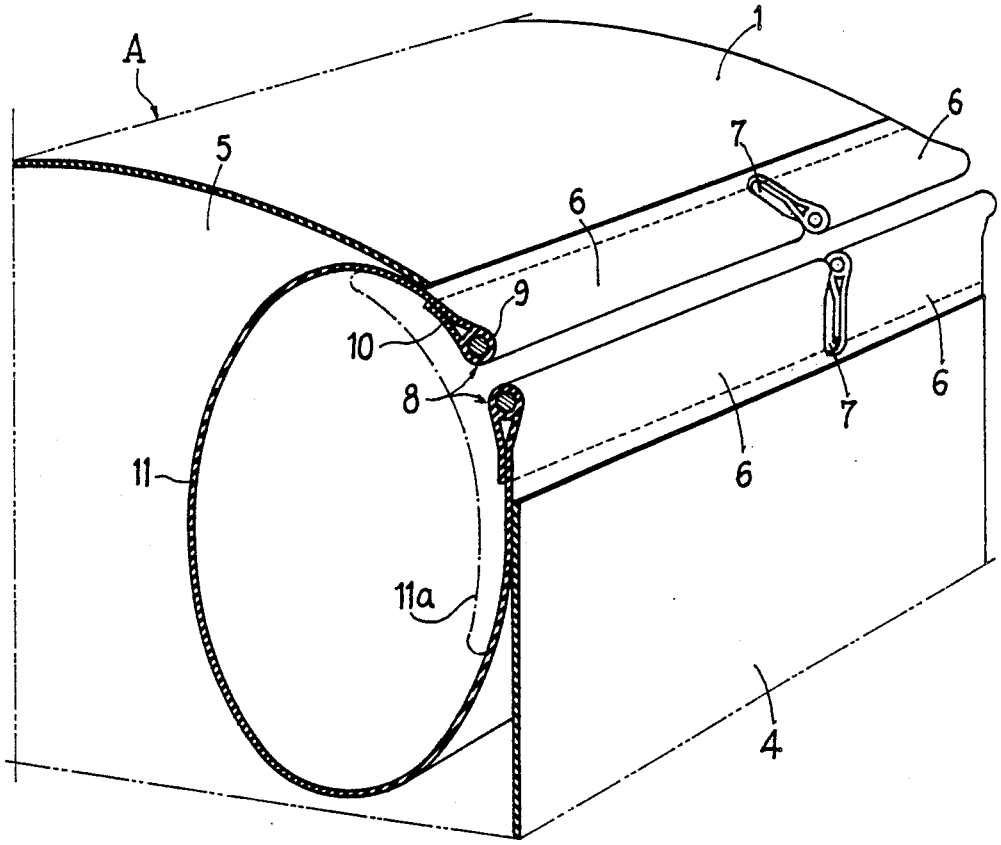
FIG. 2 is a view in perspective showing in greater detail the connection means for extending the panels of a beam.

As shown in FIG. 2, a series of flaps 6 on each beam extend from the panels 1 and 4 respectively along their longitudinal edges. These flaps 6 are slightly spaced apart, and are, for example, separated by cutouts 7; it is advantageous for them to lie opposite one another, not only in the case of different panels of the same beam, as shown in FIG. 2, but also in the case of corresponding panels of two contiguous beams. Each of these flaps is equipped at its free end with a boltrope (or bead), such as 8, consisting, for example, of a cylindrical rod 9 of flexible material held captive in a hem 10 formed by folding over and bonding to itself the fabric of the flap.

It can also be seen in FIG. 2 how the continuity of the leaktightness of the space 5 is ensured at each corner of the beam by means of a lobed membrane, such as 11. Each membrane 11 is fixed by adhesive bonding or welding to inside surfaces near the longitudinal edges of the panels 1, 2, 3 and 4 so as to form portions of the perimeters of the envelopes of the corresponding beams.

This arrangement is of particular interest because it permits easy connection of the consecutive elementary panels of the beam so as to form the confined space 5. All the connecting surfaces are accessible from outside the beam envelope so that, for example, a swan-neck press may be used for bonding the surfaces by the use of high pressure and perhaps heat.

In the embodiment shown in FIG. 2, each of the membranes 11 and its corresponding series of flaps 6 is formed of a single piece. This arrangement is not obligatory, but is particularly advantageous from the point of view of simplicity of manufacture. Each of the membranes 11 forms a flexible loop which, along with the corresponding flap 6 bordered by the boltrope 8, can be formed as a semifinished product, produced in great lengths, without requiring precision as to the width of the membrane 11. The precision work which will provide the vault with its correct dimensions will consists solely in correctly positioning the boltropes 8 in relation to the edges of the panels 1, 2, 3 and 4 of the beams. The width of the membrane 11 is of little consequence because, when the space 5 is pressurized, the membrane will be applied against the panels 1 and 4 (as shown at 11*a* in FIG. 2) and will not be subjected to tensile stresses because care will have been taken to ensure that its width from one junction to the other is substantially greater than the corresponding distance measured along the flaps as they extend from the panels.

Figure 3:
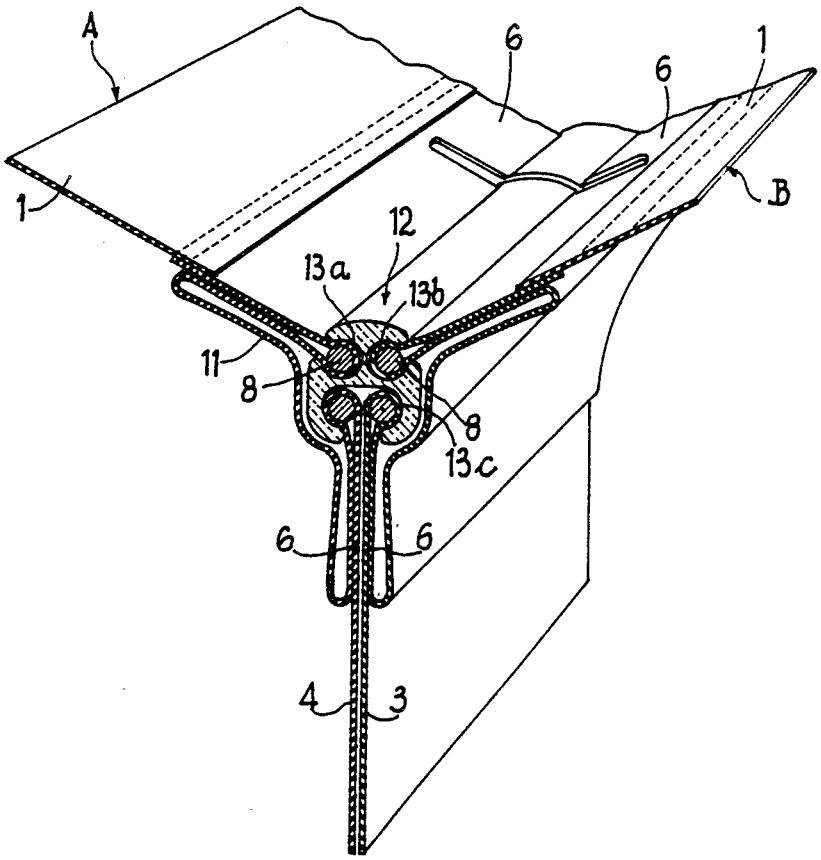
FIG. 3 is a view in perspective showing the connection of two contiguous beams.

FIG. 3 shows a portion of two contiguous beams, such as A and B in FIG. 1, including the junctions between the panels 1 and 4 of the beam A, and 1 and 3 of the beam B. The four flaps 6 which correspond and lie opposite one another are joined by a sectional member (female connector of a quick-connect means) 12 which has three dovetail-shaped slots 13, the first 13*a* of which holds captive the boltrope 8 of the flap 6 of the panel 1 of the beam A, the second 13*b* of which holds captive the boltrope 8 of the flap 6 of the panel 1 of the beam B, and the third 13*c* of which simultaneously holds captive the boltropes 8 of the flaps 6 extending from the two webs 3 and 4, which are thus disposed one against the other (the various boltropes 8 forming the male connectors of the quick-connect means).

This arrangement is particularly advantageous because on the one hand it permits easy connection of the beams to one another with the aid of a plurality of short sectional members 12 of a length which is, at most, equal to that of the flaps 6. The short length of the members 12 allows them to be inserted one after the other simultaneously along the four boltropes 8 without any difficulty. In addition, despite the use of a plurality of short sectional members 12, the tensile forces transmitted to the connection by the four panels which join the sectional members 12 together are distributed uniformly over the entire length of the connection.

Figure 4:
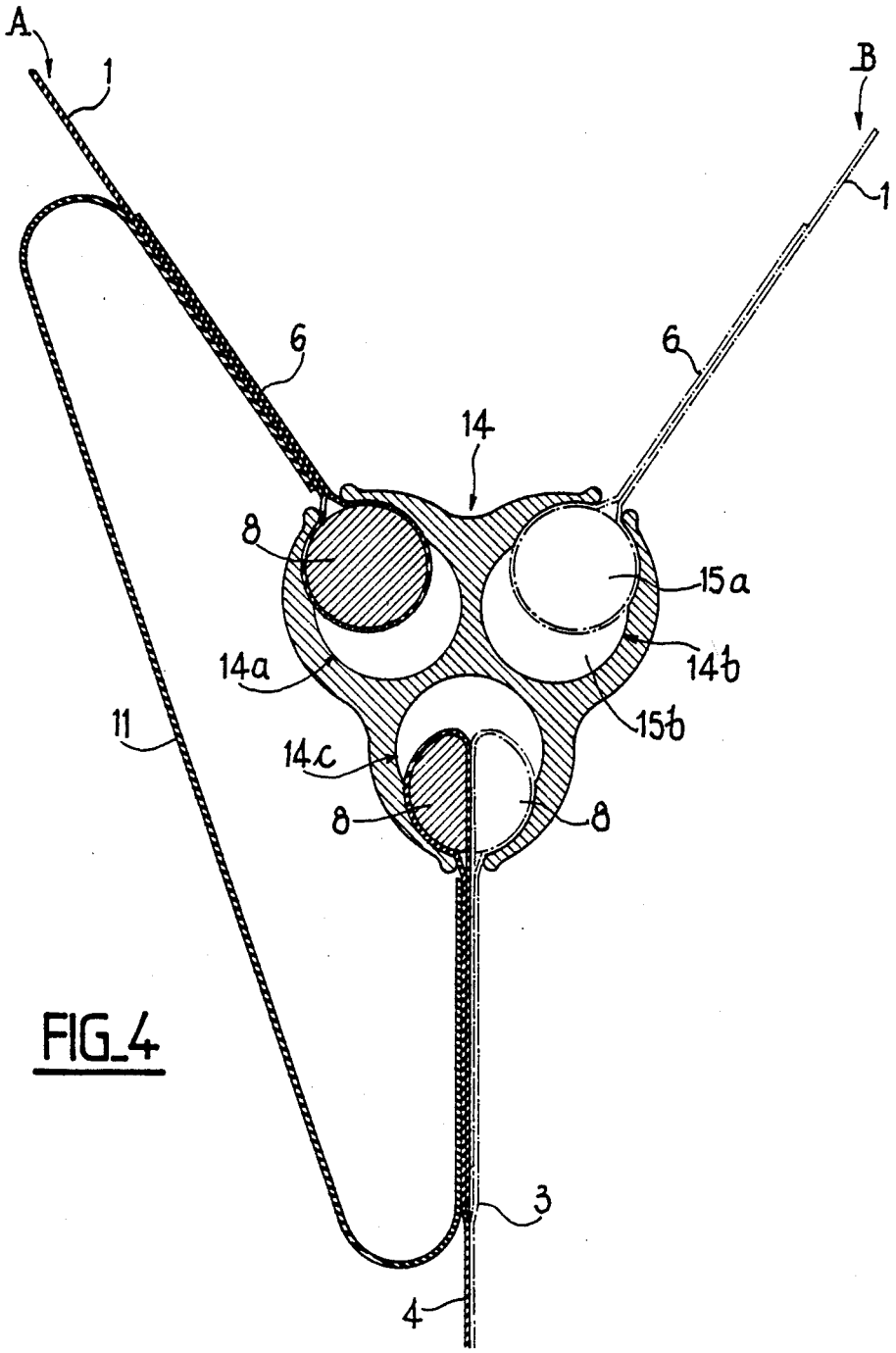
FIG. 4 is a view in section of a variant of the connection between two contiguous beams shown in FIG. 3.

FIG. 4 shows a variant of the sectional member for connecting two contiguous beams, such as the beams A and B.

The sectional member (female connector of the quick-connect means) 14 has three longitudinal slots 14*a*, 14*b*, 14*c* which hold captive the boltropes or beads (male connectors of the quick-connect means) 8 of the panels of each beam. Each slot is composed of two adjacent apertures 15*a* and 15*b* having different diameters.

Each aperture 15*b* has a diameter greater than the diameter of the boltrope 8, thus enabling the sectional member 14 to be engaged along said boltropes, while each aperture 15*a* has a diameter slightly smaller than the diameter of the boltrope, in order to lock the boltropes in the sectional member.

In addition, the boltropes 8 of the webs 3 and 4 consist of boltropes having a cross-section corresponding to half the cross-section of the boltropes of the panels 1, so that when they are placed one against the other they have a cross-section equal to the cross-section of the other boltropes.

This arrangement makes it possible to have a sectional member provided with identical slots, thus avoiding having only one orientation of the sectional member which will allow it to engage the boltropes.

Figure 5:
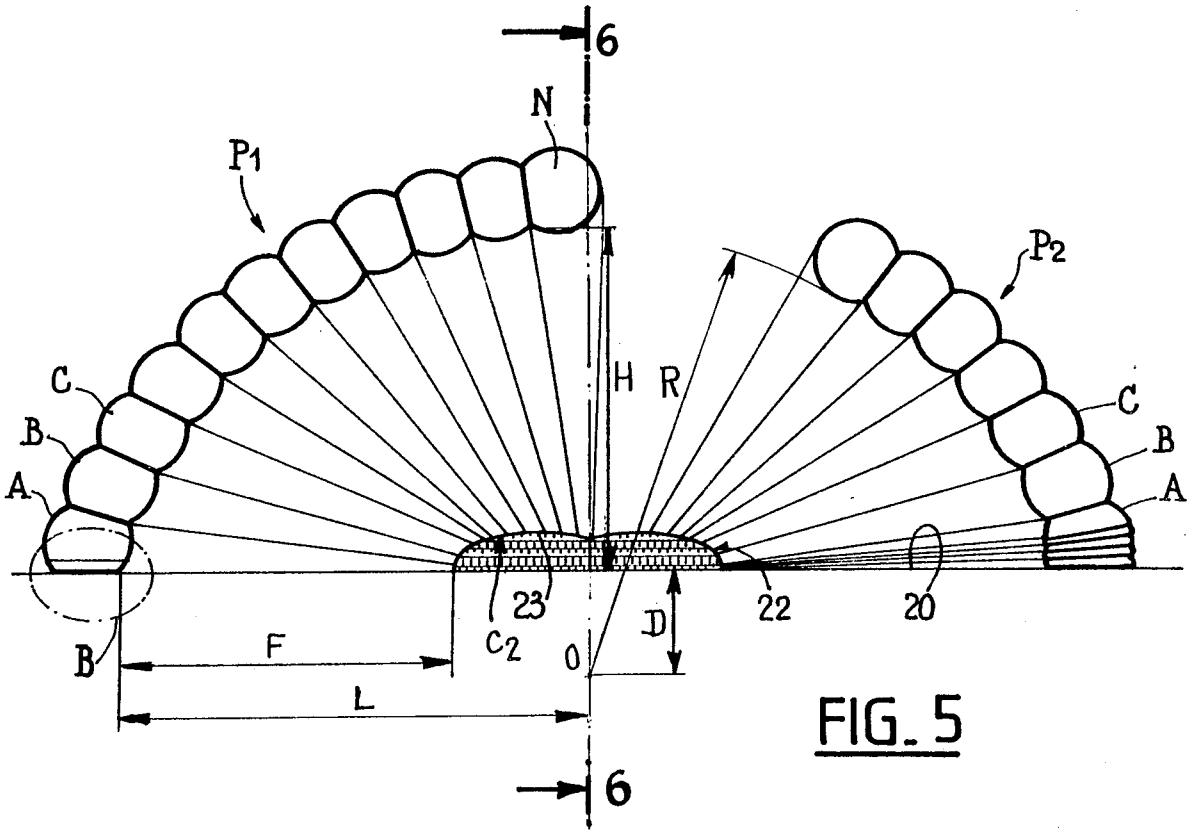
FIG. 5 is a cross-sectional elevation view of an entire vault according to the invention, taken along a plane parallel to the direction in which the vault is opened out.
Figure 6:
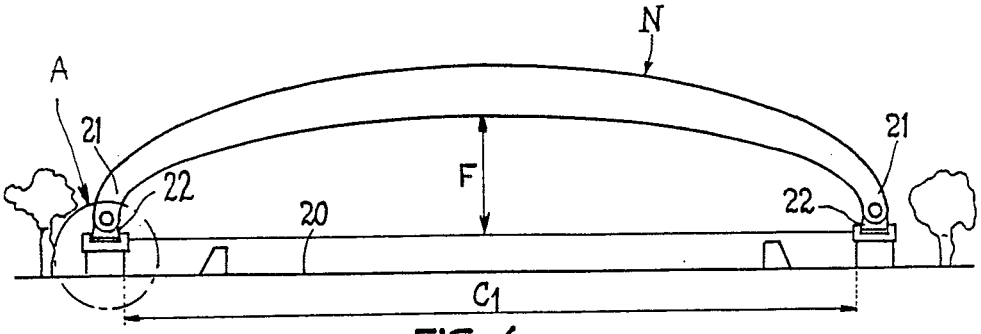
FIG. 6 is a view in section of the entire vault in the closed configuration, taken along line 6—6 in FIG. 5.
Figure 7:
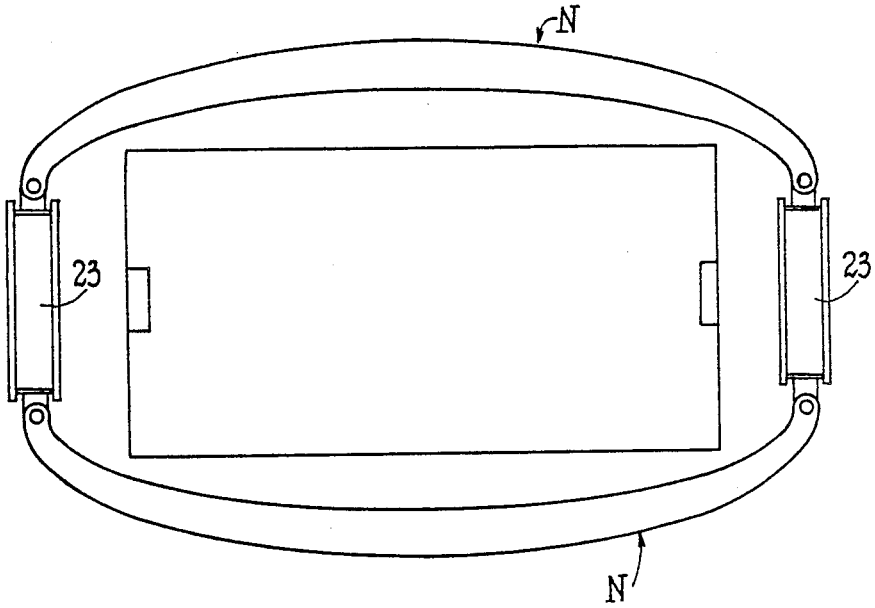
FIG. 7 is a top plan view of the entire vault shown in FIG. 6, in the open configuration.

FIGS. 5, 6 and 7 show three views of the assembly of a vault according to the invention.

It can be seen that this vault comprises two parts P1 and P2, which are advantageously symmetrical and each of which is composed of a plurality of inflatable beams A, B, C . . . connected to one another in the manner previously indicated.

This vault can, for example, cover a football field. During good weather, the vault can be completely opened with its two parts being stored flat, as shown in FIG. 7, such that all the deflated beams are laid one above the other. On the other hand, when the weather is bad, it will be possible to close the vault. FIG. 5 shows the vault in a position where the part P1 is completely closed and the part P2 is in the course of being closed, not all of its beams having yet been deflated.

To enable this superimposition of deflated beams to be achieved it is necessary for all of them to have substantially the same shape, that is to say at least the same chord C1 and the same rise F (FIG. 6). On the other hand, in most applications it is desirable for the height H (FIG. 5) of the vault to be less than the half-width L. In order for the vault to have a circular shape in a plane parallel to the direction in which it opens out, the radius of curvature R will have its center 0 at a distance D below the line 20 representing the level of the ground on which the vault rests. In order to achieve this geometry, it is necessary for the ends 21 of the arched beams to be equipped with support mounts, such as 22, which are movable members guided by guide means 23. The curvature of guide means 23 determines the unfolding path for each of the beams A, B, C . . . between the position which it occupies when it is deflated an stored flat and the position which it occupies when it is inflated and erected among the other beams. It can be seen that, all the rises F of all the beams being equal, the profile of this unfolding path is a curve C2 which is deduced from the transverse shape of the vault.

Figure 8:
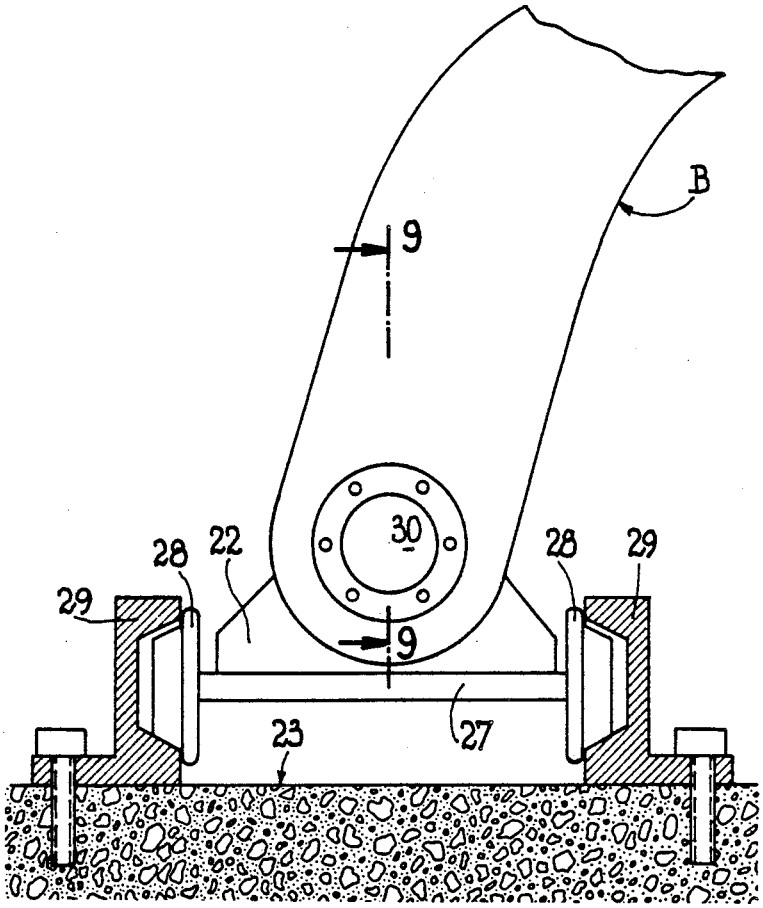
FIG. 8 is a view in section showing on a larger scale the detail A in FIG. 6.
Figure 9:
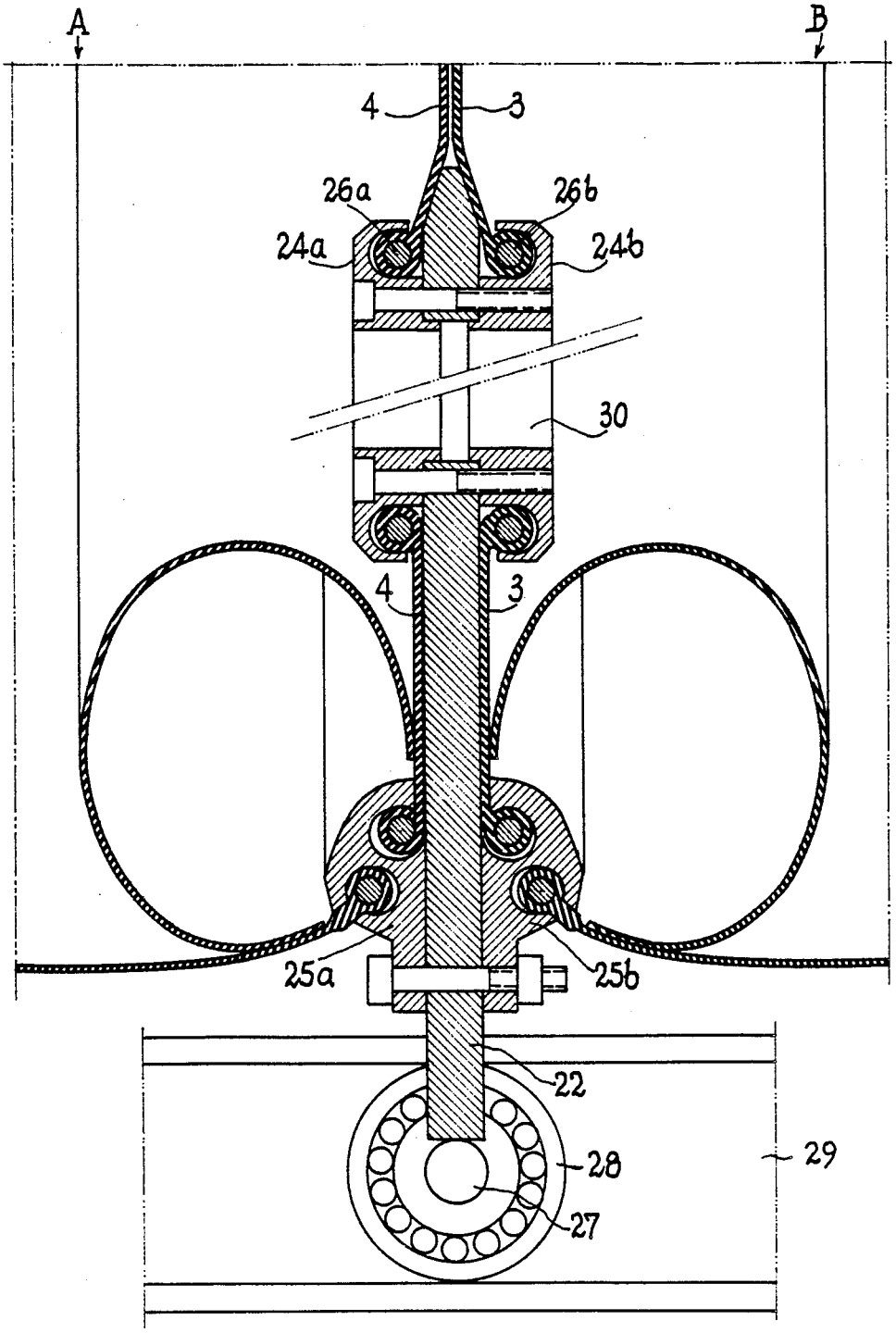
FIG. 9 is a view in section along the line 9—9 in FIG. 8.

FIGS. 8 and 9 show more accurately one of the support mounts 22 which is common to two beams, for example A and B. This mount, sandwiched between the webs 3 and 4 of said beams on which it is fixed, for example with the aid of bolted flanges 24*a*, 24*b* and 25*a*, 25*b*, extends below these beams to an axle 27 carrying at least two rollers 28 cooperating with the guide rails 29, which form a running track. In conjunction with the flanges 24*a* and 24*b* and the rods 26*a* and 26*b*, the mount 22 forms an edging which defines apertures 30 through the webs 3 and 4 of the beams A and B.

Figure 10:
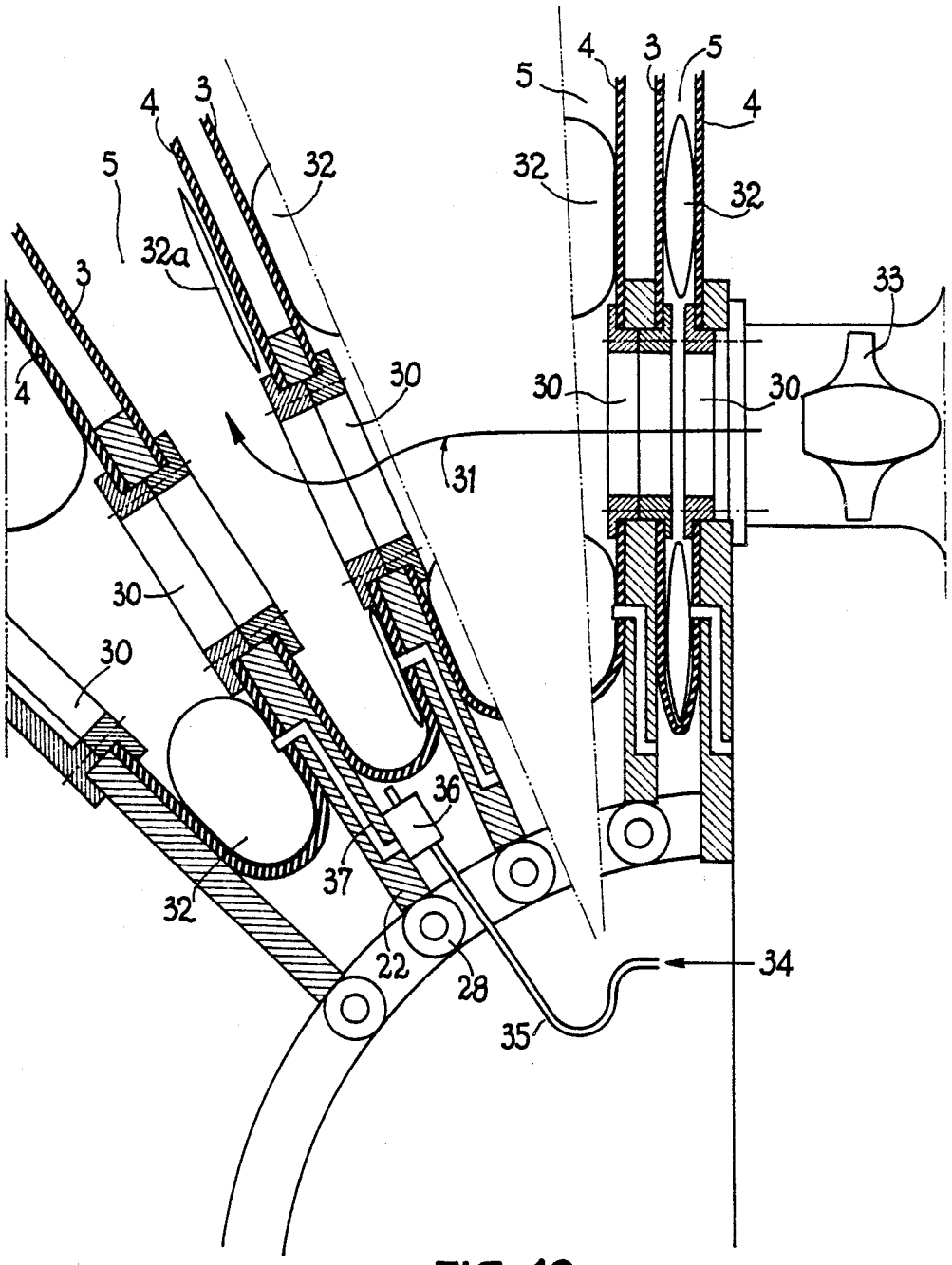
FIG. 10 is a view in section showing the supply duct common to a plurality of inflatable beams.

FIG. 10 shows a series of these apertures 30 provided through adjacent web panels 3 and 4 of the beams A, B, C . . . of the vault. This series of apertures 30 defines a duct 31 connecting the spaces 5 defined within the envelopes of the inflatable beams A, B, C . . . Communication from the duct 31 to each of the spaces 5 can be temporarily closed independently by each of a plurality of annular inflatable and flattenable bladders 32.

The bladders 32 are shown in a configuration in which, when inflated, they block this communication and isolate the spaces 5, whether the corresponding beam envelopes are empty and flat or inflated. The bladder 32*a* is shown flattened, thus opening communication between the duct 31 and the space 5 and permitting either the inflation or the deflation of said space.

A fan, shown schematically at 33 and connected to one end of the duct 31 constitutes the main source of pressurized fluid intended for the inflation or deflation of the vault.

A secondary source of pressurized fluid 34 (not shown) can deliver a fluid at a pressure higher than that of the main source, and is advantageously connected by means of flexible hoses such as 35, multiway valves such as 36, and internal ducts such as 37, to each of the inflatable bladders 32.

In another embodiment (not shown), the means for the temporary closure of the supply duct 31 may consist of pairs of inflatable and flattenable annular bladders for each beam.

Figure 11:
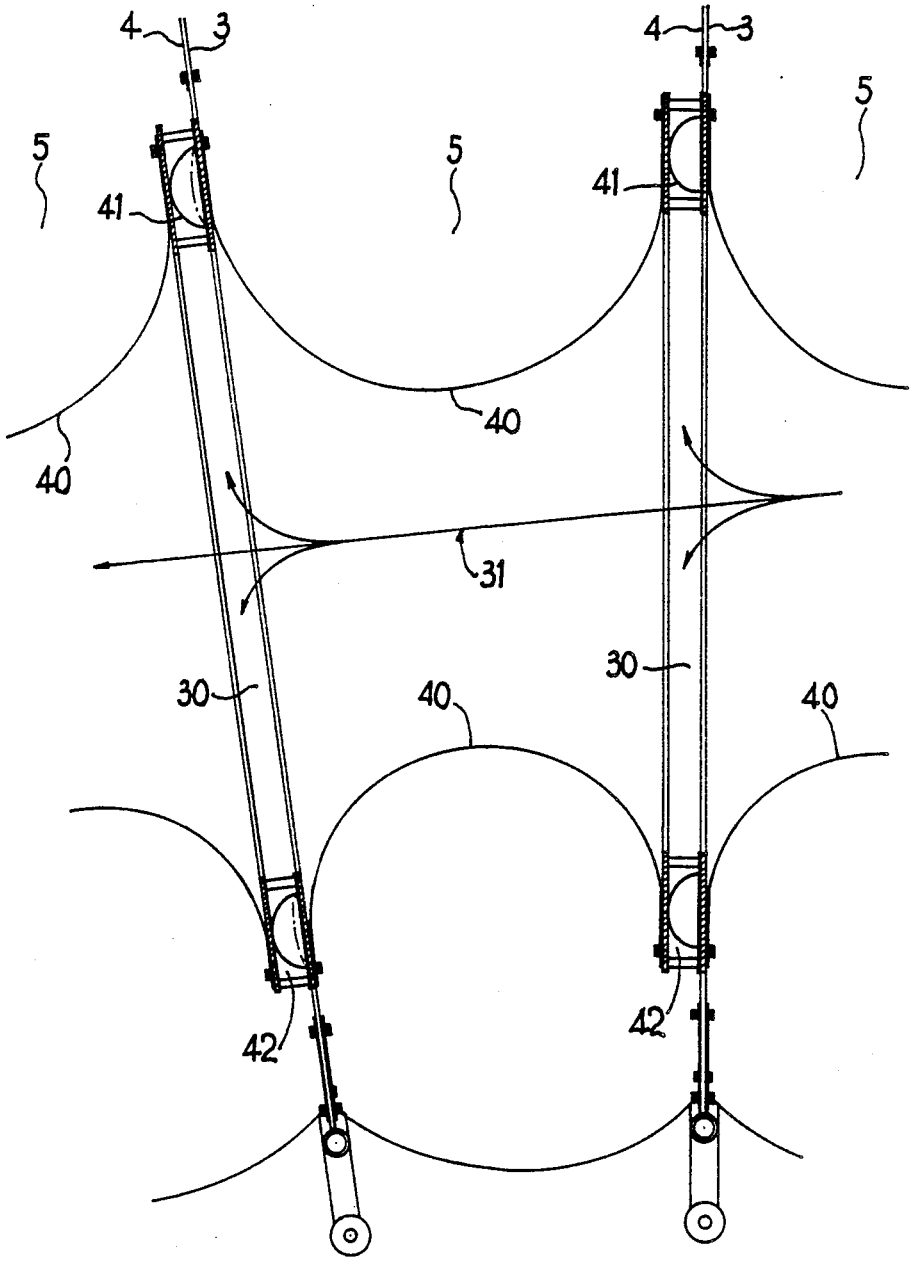
FIG. 11 is a view in section showing a variant of the supply duct common to a plurality of inflatable beams.

In yet another embodiment, which is illustrated in FIG. 11, the means for the temporary closure of the supply duct 31 comprises, inside each inflatable beam A, B, C . . . between the apertures 30, an airtight, flattenable flexible hose 40 and an inflatable, flattenable seal 41 for opening or closing the annular passage 42 between the duct 31 and the space 5 defined within each beam envelope. When unfolded, the flexible hose 40 has substantially the shape of half of a toroidal surface situated as close as possible to the center of the torus, the supply duct 31 being situated on the convex side of the hose and separated from the remainder of the space 5 which is situated on the concave side of said hose. This particular shape of the duct makes it possible to maintain the stability of its wall tensioned by the pressure, both when this pressure is higher in the space 5 than in the duct 31 and when it is higher in the duct 31 than in the space 5.

As in the case of the previous embodiment, a secondary pressurized fluid source (not shown) delivers a fluid at a pressure higher than that of the main source to each of the inflatable seals 41.

Figure 12:
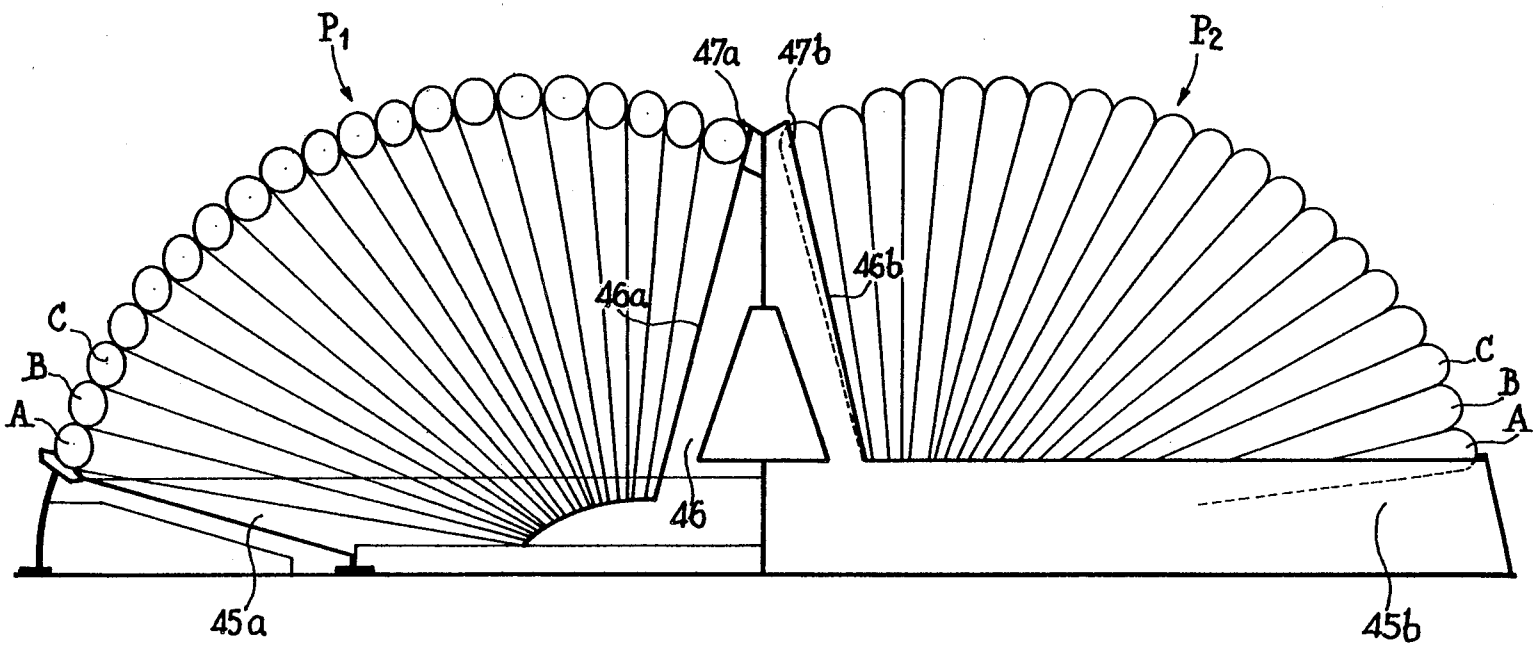
FIG. 12 is an elevation view partly in cross-section of a two-part vault incorporating a permanent rigid central arch.

In the embodiment illustrated in FIG. 12, the vault is composed of two parts P1 and P2, each of which is an assembly of flexible, inflatable envelopes forming elementary beams A, B, C . . . , which are stored in the deflated state on their bases 45*a* and 45*b* and are opened out, by inflation, towards one another so that on completion of the erection they bear against the walls 46*a* and 46*b* of a permanent rigid central arch 46. This arch 46 is equipped with guide and centering means, such as, for example, conical canopies 47*a* and 47*b*, inside which the toroidal walls of the end inflatable beams become positioned.

The arch is also equipped with a plurality of securing means (not shown), such as for example hooks which automatically secure and release the end inflatable beams.

This arrangement is particularly advantageous from the point of view of public safety in cases where the vault according to the invention is intended, for example, to cover an auditorium. If, as is highly unlikely because of the subdivision of the vault into numerous leaktight beams separate from one another, the extreme situation should arise in which all the beams were torn and deflated, the wall assembly would nevertheless remain secured to the rigid beam and thus create no risk that it could fall onto the public and hinder the evacuation of the auditorium.

In addition, the vault is anchored to the ground by partially filling a beam, advantageously situated in the bottom part of the vault, for example, with a ballasting liquid, which may simply be water.

Figure 13:
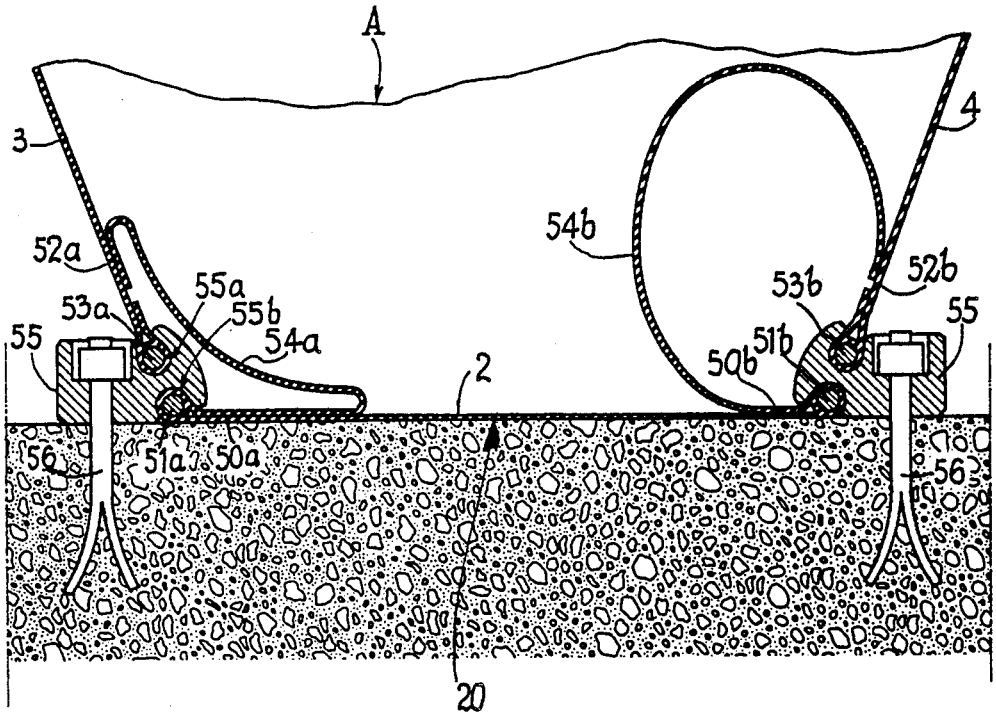
FIG. 13 is a view in section showing on a larger scale the detail B in FIG. 5.

FIG. 13 illustrates another embodiment for anchoring to the ground a vault according to the invention, which makes use of means similar to the quick-connect means enabling two contiguous beams to be connected together.

The web 2 of the beam, resting on the ground represented by the line 20, is equipped with flaps 50*a* and 50*b*, each of which is equipped with a boltrope (male connector) 51*a* and 51*b*, while the web panels 3 and 4 of the beam are equipped with flaps 52*a* and 52*b*. The beam is anchored with the aid of a series of sectional members (female connectors) 55, each of which has two slots 55*a* and 55*b*.

These sectional members 55, engaged one behind the other, will secure the whole arrangement by holding captive the end boltropes 51*a*, 51*b* and 53*a*, 53*b*, and will thus enable the beam to be anchored to the ground with the aid of a plurality of threaded rods 56 advantageously sealed in a layer of concrete.

Figure 14:
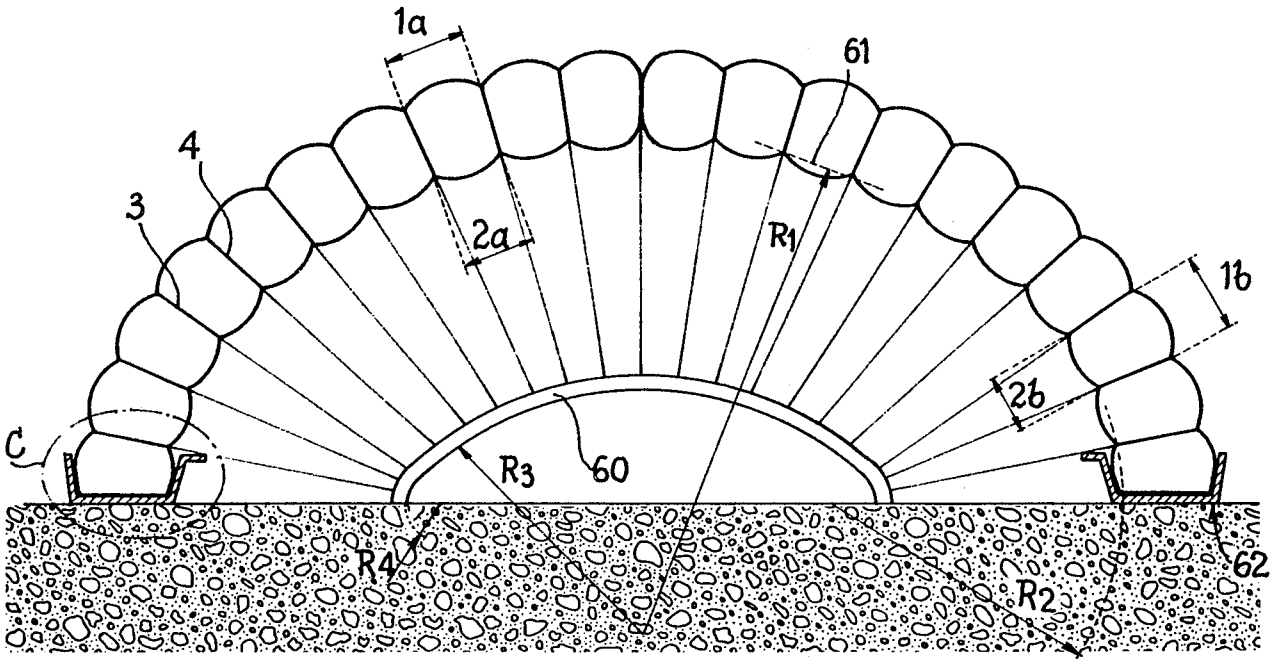
FIG. 14 is a cross-sectional view of a variant of the entire vault according to the invention taken along a plane parallel to the direction in which the vault is opened out.

FIG. 14 shows a variant of an entire vault according to the invention.

In this variant, the profile of the unfolding track 60 is a basket-handle arch composed of at least two circular arcs R3 and R4 having different radii of curvature and connected to one another. Similarly, the profile of the cross-section 61 of the vault parallel to the track 60 is a basket-handle arch formed of arcs R1 and R2. The vault is composed of box girder beams whose web panels 3 and 4 are identical. The widths 1*a* and 1*b* of outer panels 1 have a ratio with the respective widths 2*a* and 2*b* of the corresponding inner panels 2 which differs depending on whether the respective beam is situated in a zone having a radii of curvature R3 or R4. This arrangement makes it possible to produce a vault whose height is less than half its width.

Figure 15:
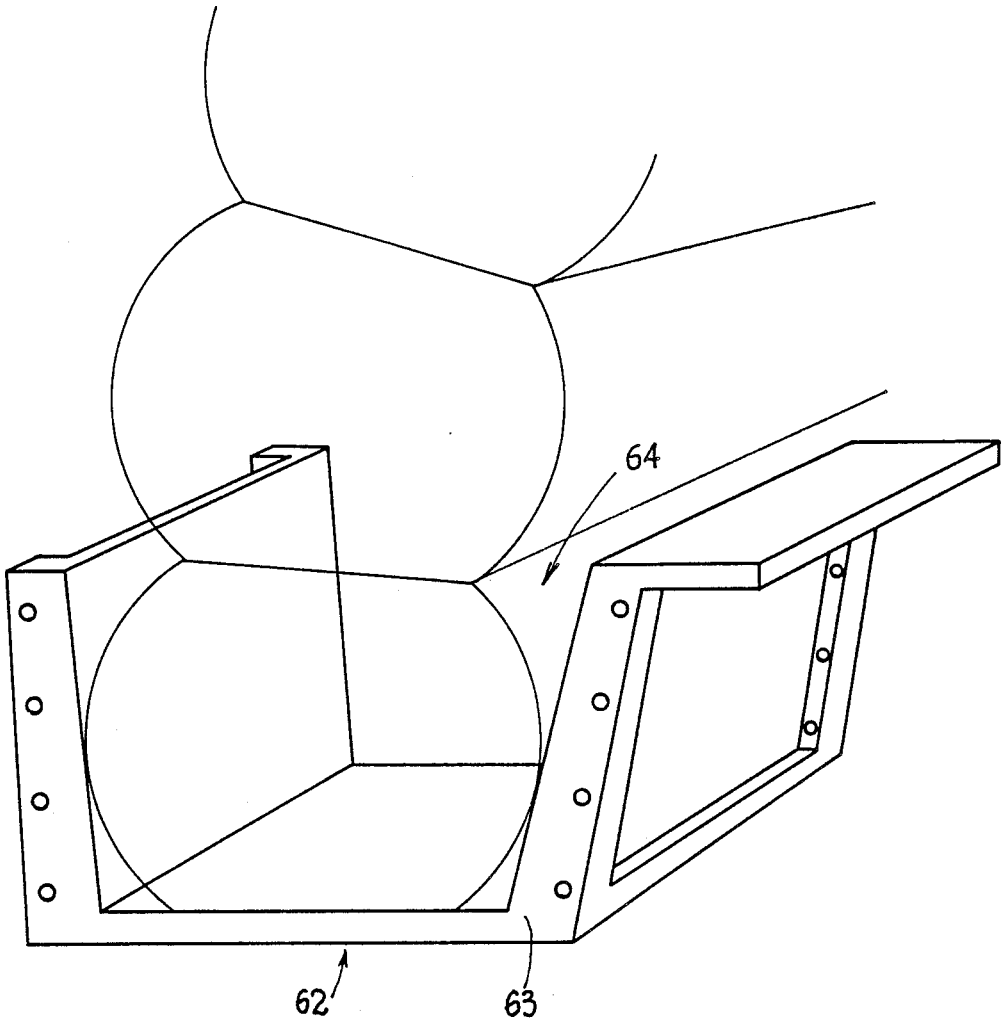
FIG. 15 is a view in perspective showing on a larger scale the detail C in FIG. 14.
Figure 16:
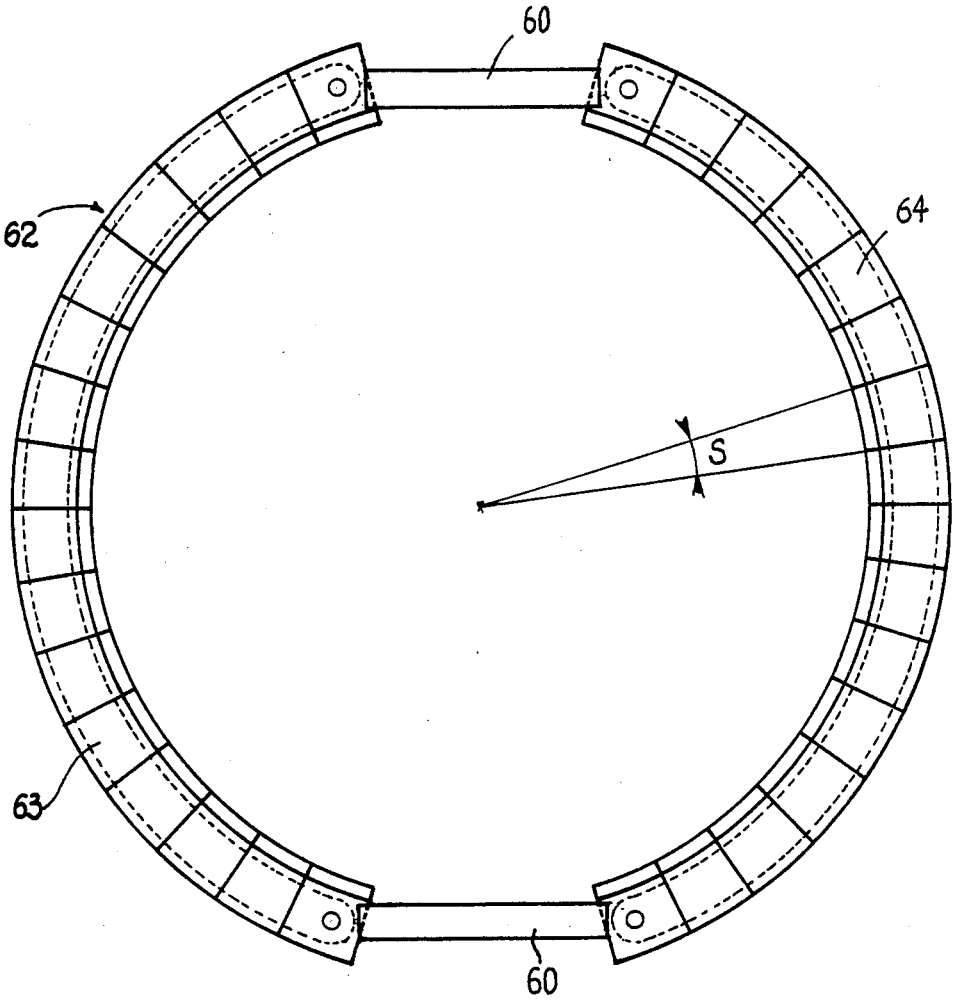
FIG. 16 is a top plan view showing the arrangement of the storage receptacles for the vault.

In order to serve the multiple functions of ballasting to resist the suction action of the wind, of forming a receptacle to store the walls of the deflated vault beams in the open position, and of forming a barrier separating and protecting the vault from the public surrounding it or from sources of fire outside or inside the vault, the vault is associated with and connected to at least one prefabricated gravity structure 62 composed of identical rigid U-shaped modular members 63 disposed side by side to form at least one substantially circular tunnel 64, of which each modular member occupies one of the sectors S (FIGS. 15 and 16).

The U-shaped modular members may be made of reinforced concrete.

Figure 17:
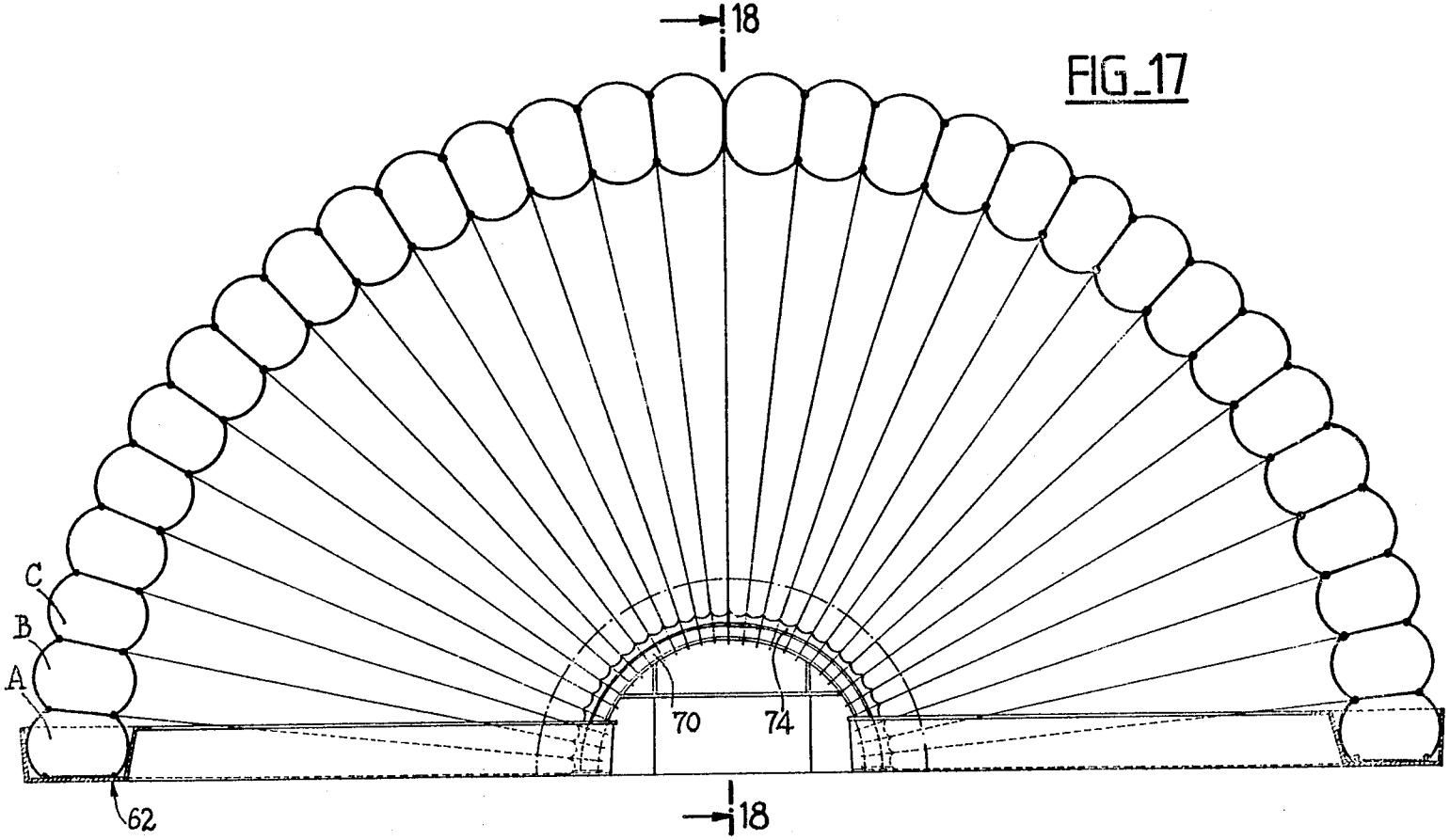
FIG. 17 is a cross-sectional view of another variant of the entire vault according to the invention, taken along a plane parallel to the direction in which the vault is opened out.
Figure 18:
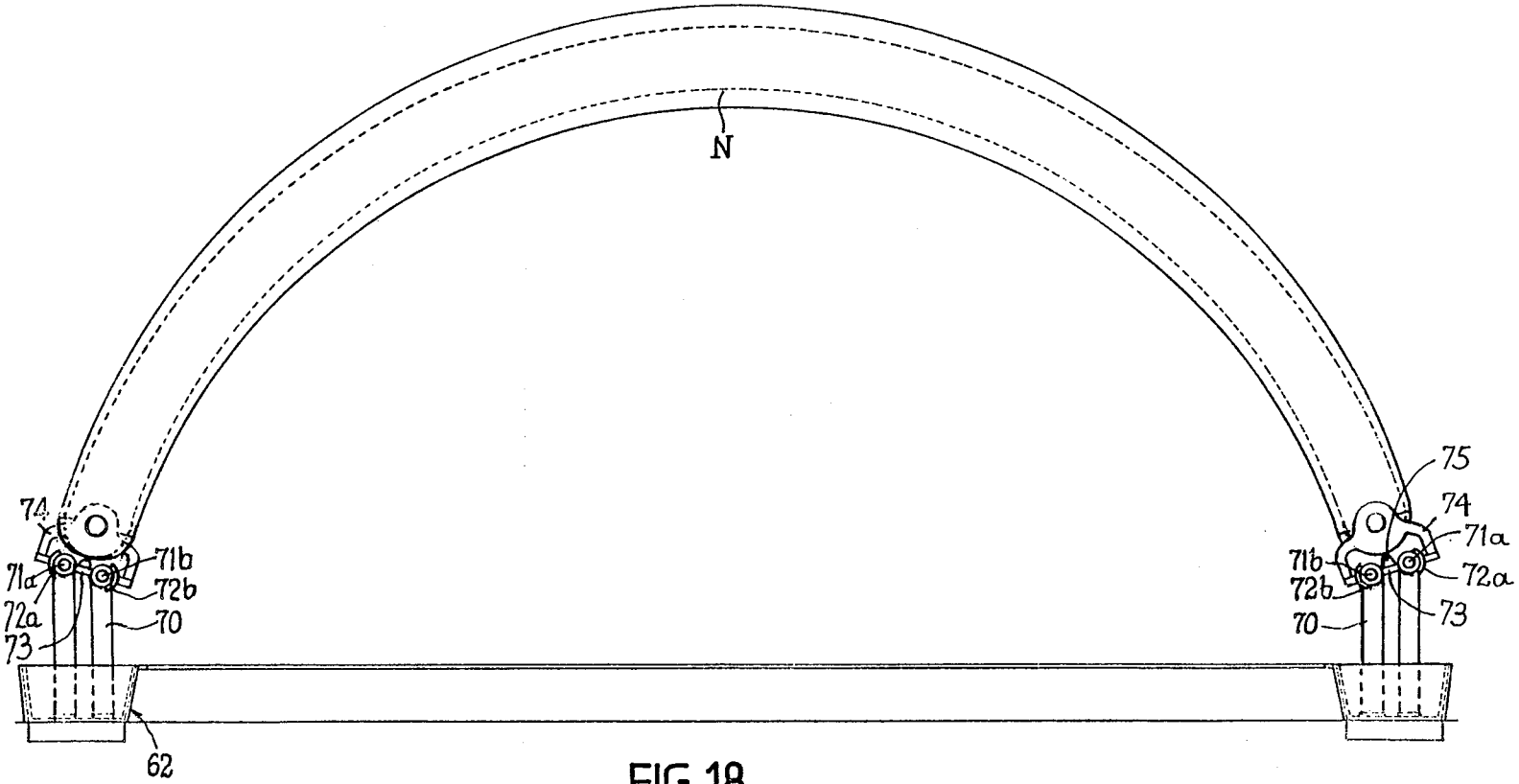
FIG. 18 is a view in cross-section taken along the line 18—18 in FIG. 17.
Figure 19:
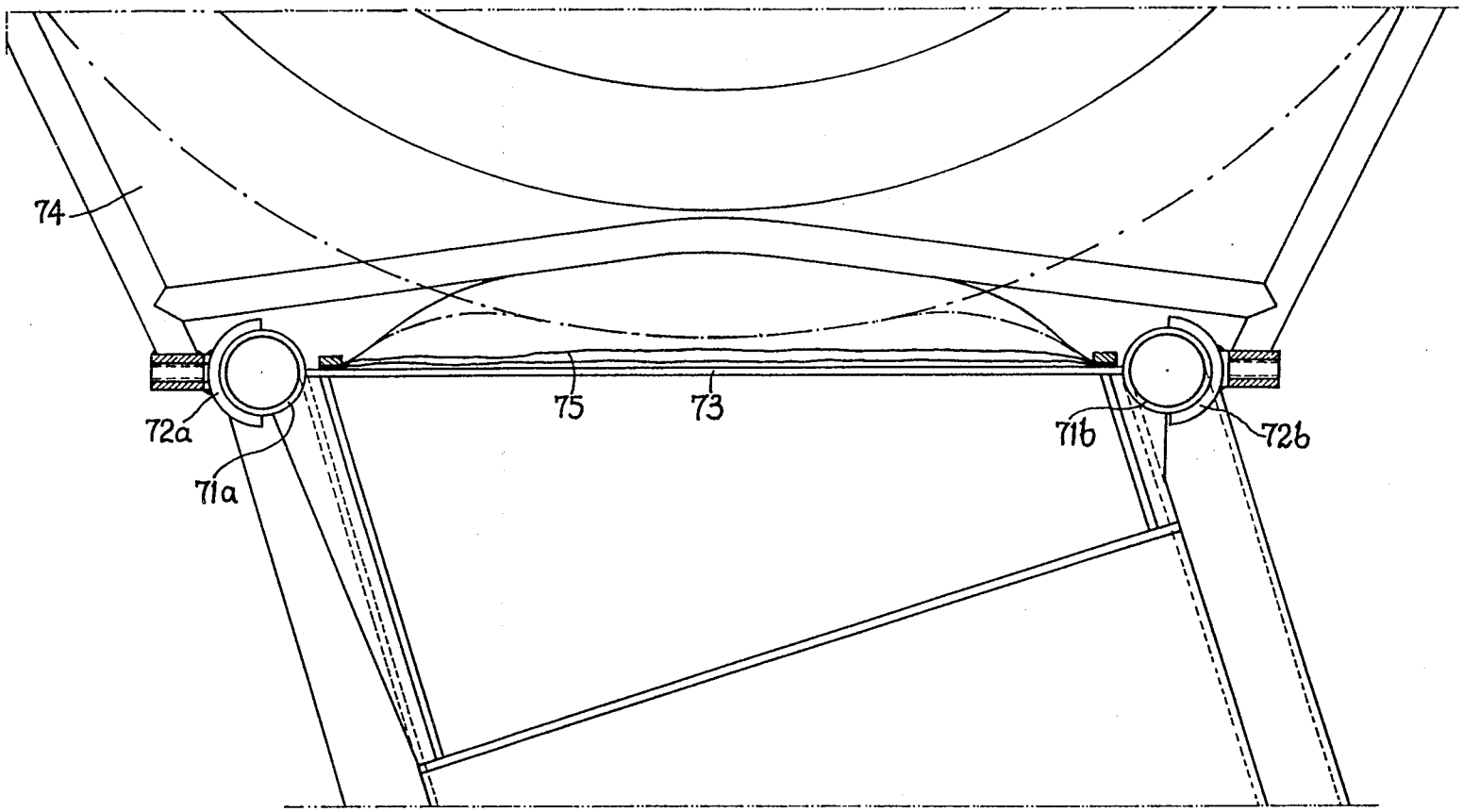
FIG. 19 is a view in section of the unfolding track according to FIGS. 17 and 18.

As can be seen in FIGS. 17, 18 and 19, each unfolding track may be composed of a rigid gutter-shaped arch 70 comprising in particular two arched tubes 71*a* and 71*b* situated in parallel planes and connected together by curved brace plates 73.

End support mounts 74 are provided for the inflatable beams A, B, C . . . Each of the mounts 74 has two shoes 72*a* and 72*b* pivotally mounted thereto and extending inwardly therefrom to cooperate with the tubes 71*a* and 71*b* (as shown in FIG. 19). The shoes 72*a* and 72*b* partly surround and slide along the tubes 71*a* and 71*b* to guide the inflatable beam envelopes of the vault as the vault opens out and to support and retain them when they are subjected to the action of the wind when the vault is in the closed position.

This unfolding track is also associated with an inflatable and flattenable cushion 75 which when inflated, bears against the curved brace plate 73 and extends along at least part of the length of the arch 70, between the guide tubes 71*a* and 71*b*. The cushion 75 is deflated during the operation of opening out or retracting the vault and is inflated when the opening out is completed, in order on the one hand to close off the space lying between the arch and the ends of the opened out beams so as to make the vault weatherproof, and on the other hand to eliminate the operating clearance necessary for the sliding of the shoes on the guide tubes, so as to apply a force against the beams and avoid the rattling of the vault through the action of gusts of wind.

Figure 20:
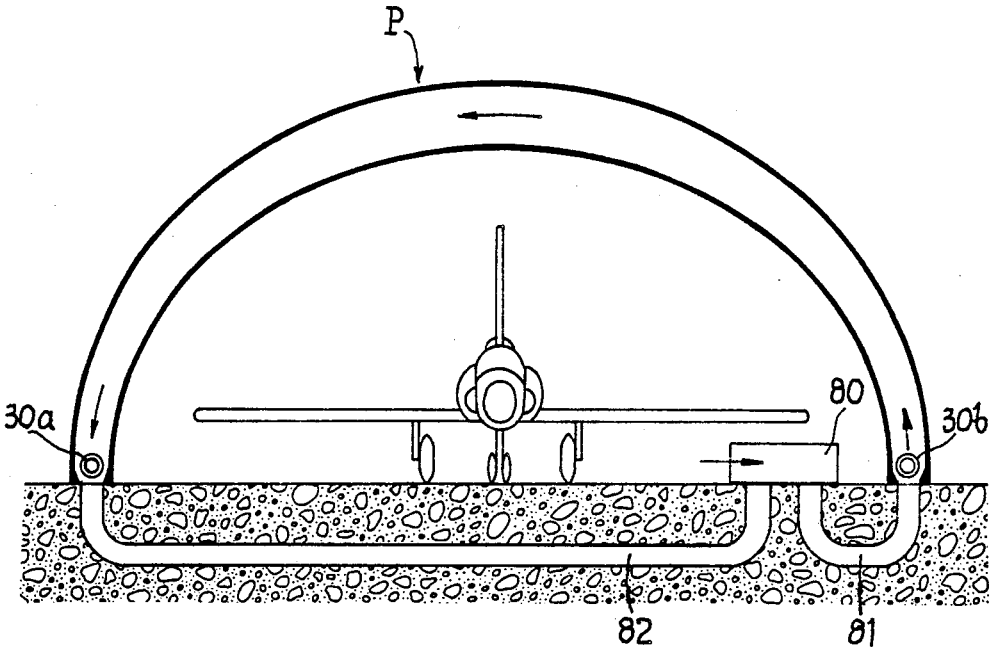
FIG. 20 is a view in cross-section of the entire inflatable vault serving as a hanger for an aircraft.

FIG. 20 shows a vault comprising a plurality of beam envelopes according to the invention which is used as a means for protecting and camouflaging movable equipment, such as an aircraft, which must be able to enter and leave the vault, possibly under its own power.

For this purpose the vault P comprises one or two parts which can be retracted, and another part which can remain in place to support the retracted parts. These parts are retracted by deflating and placing the beams under reduced pressure. It is thus possible to clear an access simultaneously at both ends of the vault, thus making it possible, for example, for an aircraft to move out by its own means, making use of the thrust of its jet engine.

All the inflatable beams of which the vault is composed, whether they are incorporated in the part remaining inflated or in the retractable parts, are connected together by common supply ducts 30*a* and 30*b*, and are connected by ducts 81 and 82 to a pressurized fluid generator 80, which also thermally conditions said fluid. In this application, the generator is a fluid refrigeration unit which feeds a heat exchanger consisting of all the beams. The heat exchanger advantageously provides a closed circuit flow whose path follows in succession the duct 81, the duct 30*b*, the beams which form multiple ducts connected between the duct 30*b* and the duct 30*a*, and the return duct 82. This arrangement makes it possible to enclose the aircraft in a cold zone in order to delete the thermal signature of its jet engine after a flight and make it invisible to infrared radiation sensitive detection means.

Figure 21:
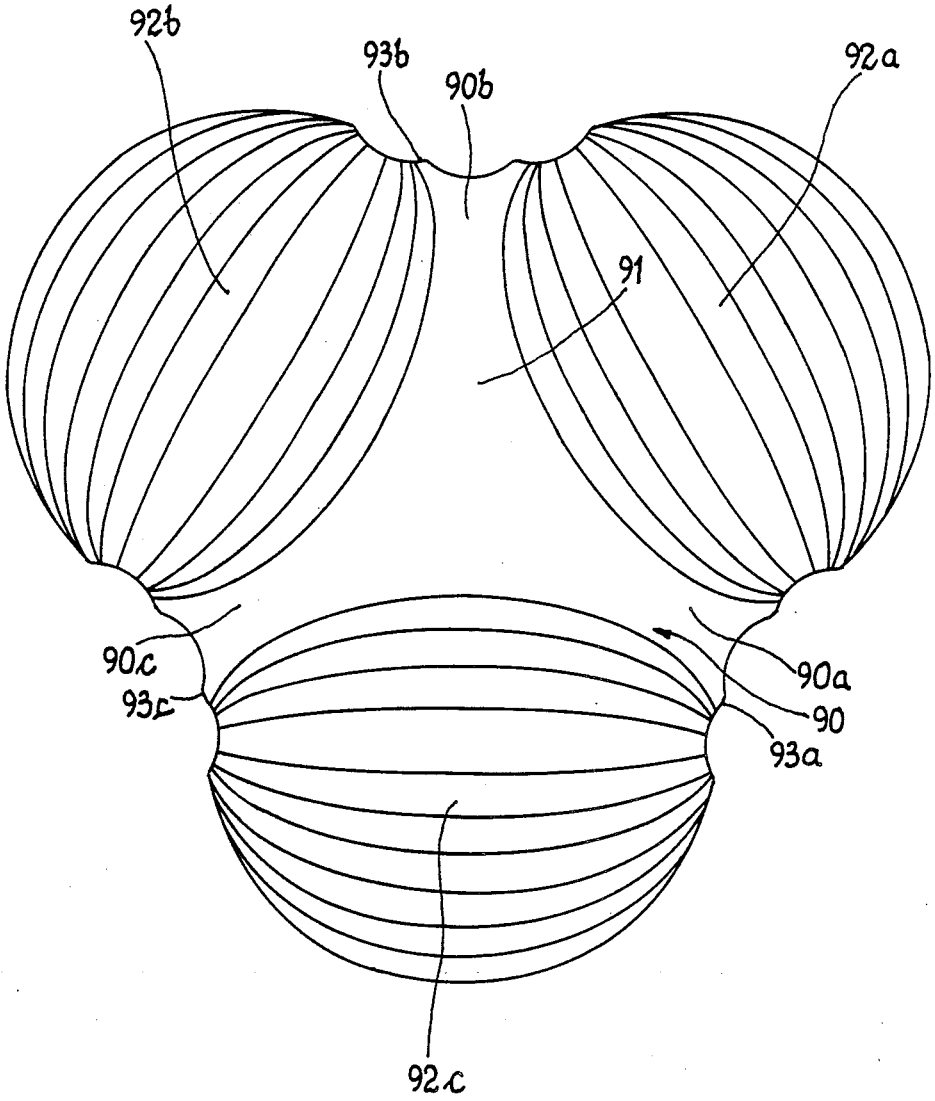
FIG. 21 is a top plan view of a different arrangement of the entire inflatable vault associated with a rigid arched structure having three points of support on the ground.

FIG. 21 shows a vault according to the invention, which includes a rigid part 90, which is an arched vault comprising, for example, three half arches 90*a*, 90*b*, 90*c* spaced 120° from one another and joined at a common apex 91. The vault further includes three advantageously identical inflatable parts 92*a*, 92*b*, 92*c*, each of which is composed of an assembly of the previously described inflatable beams. This rigid vault advantageously rests on the ground at three support points 93*a*, 93*b* and 93*c*.

Based on the same principle, it is thus possible to conceive vaults comprising a plurality of half-arches, optionally of different dimensions, to form various architectural compositions.

All these beams can be connected together, while deflated and laid one on the other at ground level, with the aid of the previously described connection means, and can be opened out by successively inflating the beams. The spaces lying between the guide tracts and the ground can advantageously be used as zones giving access to the interior of the vault.

In general, the pressurized fluid supply means may consist of an axial flow fan used to inflate the beams A, B, C . . . Such axial flow fan can also have its direction of rotation reversed so as to deflate the beams, place them under negative pressure or maintain them under negative pressure.

In a variant, the pressurized fluid supply means may also consist of at least two simultaneously operating air generators, each connected to one of the supply ducts situated at the two ends of the beams A, B, C . . . One of these two generators blows out pressurized air to inflate and open out the beams in one part, while the other generator draws out the air contained in the beams of another part of the vault in order to hold the walls of the part folded and applied one against the other through the negative pressure thus generated.

Finally, the longitudinal panels of the flexible envelope of the inflatable beams A, B, C . . . may be made from a mesh or network of spaced textile cords, of the order of 0.2 to 2 centimeters, adhering to at least one sheet composed of at least one layer of plastics material, of which at least one is impermeable to gases and at least one is heat sealable. This sheet provides leaktightness by filling the space left between the cords.

The advantages of the present invention result essentially from the fact that it makes it possible to produce vaults of very large dimensions which are composed of a plurality of elements which are easilY manufactured, easily transported, and easily assembled on the site, and which can be erected and retracted very quickly.

The inflatable vault according to the present invention is applicable to the production of coverings for stadiums, swimming pools, tennis courts, sports halls, restaurants, auditoriums, exhibition halls, shops, leisure parks, congress halls, storage hangers and other various large installations.

It is more particularly suitable for the protection against bad weather of places which are frequented by the public and which it is nevertheless desired to uncover in good weather, but it may also be applied to permanently covered installations.

I claim:

1. An inflatable vault comprising:

a plurality of contiguous individually inflatable leaktight hollow beams, each hollow beam including at least two longitudinal elongated panels connected together along neighboring longitudinal edges thereof in a sequential manner, and a longitudinally elongated flexible membrane connected in a leaktight manner between each pair of said neighboring edges of said panels; and quick-connect means for mutually connecting the longitudinal edges of each respective pair of neighboring longitudinal edges of said panels and for connecting each said pair of neighboring edges to a corresponding pair of neighboring edges of panels of an adjacent one of said plurality of leaktight hollow beams.

2. An inflatable vault as recited in claim 1, wherein said quick-connect means comprises:

a longitudinally elongated flap extending from each of said longitudinal edges of each of said panels and having a free end, each of said flaps having a longitudinally elongated bead connected along said free end; and a plurality of elongated female connectors, each female connector having a plurality of longitudinally elongated slots for receiving and retaining said elongated beads therein.

3. An inflatable vault as recited in claim 2, wherein each of said flaps comprises a plurality of flap sections arranged along one of said longitudinal edges of one of said panels; and each of said plurality of female connectors comprises a plurality of female connector sections, each of a length which is equal to or shorter than the length of each of said flap sections.

4. An inflatable vault as recited in claim 2, wherein each elongated slot of each of said female connectors includes a first longitudinally elongated cylindrical void having a first diameter which is greater than a diameter of each of said beads, and a second longitudinally elongated void located adjacent to and radially outwardly of said first void and having a diameter slightly less than that of each of said beads.

5. An inflatable vault as recited in claim 1, wherein each of said flexible membranes is connected between each said pair of said neighboring edges of said panels by being connected to respective inside surfaces of said panels adjacent each of said longitudinal edges of each of said pairs of neighboring longitudinal edges.

6. An inflatable vault as recited in claim 5, wherein each of said loops is formed of a unitary leaktight member.

7. An inflatable vault as recited in claim 5, wherein each of said flexible membranes is connected to inside surfaces of an adjacent pair of said panels in such a way as to form a loop, which when collapsed along an inside surface of a respective beam has a width dimension which is substantially greater than a distance measured between a corresponding pair of said neighboring edges of said panels when said neighboring edges are mutually connected by said quick-connect means.

8. An inflatable vault as recited in claim 1, wherein said at least two longitudinally elongated panels comprises four longitudinally elongated panels which form a box girder and include an outer panel, an inner panel and first and second web panels, said outer and inner panels of said plurality of beams together forming respective inner and outer walls of said vault and said first and second web panels forming respective bracing ribs for each beam which provide structural support and ensure leak-tightness of each individual beam.

9. An inflatable vault as recited in claim 8, further comprising a pair of fixed elongated guide tracks; and guide means, connected respectively to said first and second web panels of each longitudinal end of respectively adjacent beams, for slidably mounting said beams to said guide tracks for movement therealong.

10. An inflatable vault as recited in claim 9, wherein each of said beams, when inflated, extends upwardly and inwardly from each of its longitudinal ends so as to form an arch, each of said arched beams having substantially equal chord lengths and substantially equal rise lengths.

11. An inflatable vault as recited in claim 9, wherein when all of said beams are inflated, the vault has a cross-sectional shape along a plane perpendicular to said beams which corresponds to a shape of each of said guide tracks.

12. An inflatable vault as recited in claim 11, wherein said cross-sectional shape of the vault is a basket-handle arch shape formed by a first arc having a first radius and a second arc having a second radius greater than said first radius; and each beam disposed along said first arc has a ratio between widths of its outer and inner panels which is different than a ratio between widths of outer and inner panels of beams disposed along said second arc.

13. An inflatable vault as recited in claim 9, wherein each of said guide tracks comprises at least one arch-shaped tubular member with at least one guide surface; and said guide means comprises at least one support mount connected to said first and second web panels of said beams and at least one guide shoe connected to said support mount and slidable on said at least one guide surface of said at least one arch-shaped tubular member.

14. An inflatable vault as recited in claim 13, further comprising an inflatable cushion disposed between at least one of said guide tracks and said at least one support mount.

15. An inflatable vault as recited in claim 8, wherein each of said first and second web panels of each of said beams includes an aperture therethrough to provide for passage through said beams of a pressurizing fluid.

16. An inflatable vault as recited in claim 15, further comprising a source of pressurizing fluid including two air generators, a first of said air generators being connected to a beam of said plurality of beams which is located at a first end of said vault and a second of said air generators being connected to a beam of said plurality of beams which is located at a second end of said vault opposite said first end of said vault, such that one of said first and second air generators can provide pressurized air for inflating a first set of said beams and the other of said first and second air generators can remove pressurized air from a second set of said beams.

17. An inflatable vault as recited in claim 15, further comprising a source of pressurizing fluid including an axial flow fan means for providing pressurizing fluid to said beams so as to cause inflation thereof when rotated in one direction and for removing said pressurizing fluid from said beams so as to cause deflation thereof when rotated in a direction opposite said one direction.

18. An inflatable vault as recited in claim 15, further comprising temporary passageway forming means for selectively forming a single supply duct, through said apertures formed through said side panels, which is fluidically separated from a remainder of the space within said beams.

19. An inflatable vault as recited in claim 18, wherein said temporary passageway forming means comprises a plurality of inflatable annular bladders, each of which is disposed within one of said beams and about an imaginary cylinder defined between said apertures formed in said first and second web panels, each of said annular bladders being independently inflatable.

20. An inflatable vault as recited in claim 18, wherein said temporary passageway forming means comprises:

a leaktight, flattenable flexible hose within each beam extending between the apertures in said first and second web panels;

an annular passage in each of said beams between said flexible hose and a remainder of the space within each respective one of said beams; and an annular inflatable bladder disposed in each of said annular passages, said annular bladders being independently inflatable.

21. An inflatable vault as recited in claim 1, wherein each of said beams forms a fluid flow duct through which fluid can flow from one longitudinal end to another, and fluid flow generating means is provided for generating a flow of fluid through said fluid flow ducts and for controlling the pressure, temperature, and humidity of said flow of fluid, such that said fluid flow ducts and said fluid flow generating means form a heat exchanger.

22. An inflatable vault as recited in claim 1, further comprising anchor means, comprising a plurality of quick-connect type sectional connectors, for anchoring said plurality of inflatable beams to the ground by connecting together and to the ground at least two panels of at least one of said beams which is adjacent the ground.

23. An inflatable vault as recited in claim 1, further comprising anchor means, comprising ballasting liquid disposed in at least one of said beams, for anchoring said plurality of beams to the ground.

24. An inflatable vault as recited in claim 1, further comprising anchor means, comprising an annular through formed of a plurality of rigid U-shaped trough sections connected to at least one of said plurality of beams, for anchoring said plurality of beams to the ground and for protecting beams adjacent the ground against damage.

25. An inflatable vault as recited in claim 1, wherein each of said panels of said plurality of beams comprises at least one layer of leaktight plastic material, at least one layer of heat sealable plastic material, and a layer of textile cables adhered to at least one of said layers of plastic material.

26. An inflatable vault comprising:

a collapsible cover member including a plurality of elongated inflatable arch-shaped beams connected sequentially and contiguously along longitudinal sides thereof;

two guide tracks disposed perpendicular to said longitudinal sides of said beams and spaced apart in the longitudinal direction of said beams so as to be positioned at respectively opposing ends of said cover member; and guide means, connected to each longitudinal end of said cover member, for slidably mounting said cover member to said two guide tracks to move therealong.

27. An inflatable vault as recited in claim 26, wherein said guide means comprises a plurality of first guide members connected along a first longitudinal end of said cover member and a plurality of second guide members connected along a second longitudinal end of said cover member.

28. An inflatable vault as recited in claim 27, wherein each of said guide tracks includes an arch-shaped tubular member; and each of said guide members comprises a pair of guide shoes shaped to slide along a surface of said arch-shaped tubular member.

29. An inflatable vault as recited in claim 27, wherein each of said guide tracks comprises a pair of spaced apart guide rails having opposing guide grooves therein; and each of said guide members comprises two rollers for rolling, respectively, within said guide grooves of said guide rails.

30. An inflatable vault as recited in claim 27, wherein each of said plurality of beams comprises four longitudinally elongated panels connected sequentially together in a leaktight manner to form a box girder type beam, said four panels including an outer panel, an inner panel, and first and second web panels;

each of said plurality of first guide members is connected to a first longitudinal end of one of said web panels of one of said beams and to a first longitudinal end of an adjacent one of said web panels of another of said beams; and each of said plurality of second guide members is connected to a second longitudinal end of one of said web panels of one of said beams and to a second longitudinal end of an adjacent one of said web panels of another of said beams.

* * * * *